United States Patent [19]

Claybaugh

[11] 3,979,339

[45] Sept. 7, 1976

[54] HARD SURFACE CLEANING COMPOSITIONS

[75] Inventor: Gene W. Claybaugh, Cincinnati, Ohio

[73] Assignee: The Procter & Gamble Company, Cincinnati, Ohio

[22] Filed: Mar. 18, 1975

[21] Appl. No.: 559,460

[52] U.S. Cl. ..... 252/524; 252/89 R; 252/135; 252/531; 252/532; 252/539; 252/542; 252/550; 252/551; 252/558; 252/DIG. 2; 252/DIG. 15

[51] Int. Cl.[2] ..... C11D 3/37

[58] Field of Search ..... 252/DIG. 2, DIG. 15, 252/524, 542, 135, 89, 531, 532, 539, 99, 550, 551, 558

[56] References Cited

UNITED STATES PATENTS

| | | | |
|---|---|---|---|
| 3,634,260 | 1/1972 | Pickin | 252/99 X |
| 3,689,435 | 9/1972 | Berni et al. | 252/DIG. 15 X |
| 3,781,228 | 12/1973 | McDonnell et al. | 252/135 X |
| 3,839,214 | 10/1974 | Schwalley et al. | 252/524 X |
| 3,868,336 | 2/1975 | Mazzola | 252/DIG. 2 X |

*Primary Examiner*—Harris A. Pitlick
*Attorney, Agent, or Firm*—George W. Allen; Douglas C. Mohl; Richard C. Witte

[57] ABSTRACT

Granular hard surface cleaning compositions containing low levels of certain water-soluble or dispersible polymeric materials. Incorporation of nonionizing polymers such as polyvinyl alcohol, and polyvinyl pyrrolidone into hard surface cleaning compositions unexpectedly provides improved soil removal over a variety of surfaces and types of soil.

5 Claims, No Drawings

HARD SURFACE CLEANING COMPOSITIONS

BACKGROUND OF THE INVENTION

This invention relates to hard surface cleaning compositions. More particularly, this invention relates to granular built, hard surface cleaning compositions containing low levels of surfactant in combination with low levels of certain water-soluble or dispersible nonionizing polymers. Such polymers aid in removal of soil from hard surfaces.

Hard surface cleaning compositions are a class of detergent compositions adapted to meet the variety of requirements necessary for overall optimum performance in hard surface cleaning usage. Generally, granular hard surface cleaning compositions contain less than 5% by weight surfactant (often considerably less) and often have high levels of organic and inorganic builders.

Granular hard surface compositions are formulated in this way for a number of reasons related to the unique performance requirements involved in hard surface cleaning. Hard surface cleaning products must possess the capability of removing highly substantive soil from many different types of hard surfaces. This soil removal capability must be provided by products which are safe for household use and which do not harm the variety of hard surfaces encountered in home and industry. Moreover, hard surface cleaning compositions should not leave streaks or noticeable film on the surface after soil removal. Still further, such compositions must not produce excessive foam in use since foam can be time and effort consuming to remove. In short, realization of optimum hard surface cleaning products has required extensive and inventive efforts to provide maximum cleaning efficacy within the constraints of economically suitable and conveniently employed, finished end products.

Examples of granular hard surface cleaning compositions appear in U.S. Pat. No. 3,223,646, issued Dec. 14, 1965 to McKenna et al, and entitled "DRY FREE-FLOWING DETERGENT COMPOSITION AND METHOD OF PREPARATION" and, moreover, in the current market place. Copending application Ser. No. 559,461, filed on even date herewith by Claybaugh entitled "Hard Surface Cleaning Compositions" describes both granular and liquid hard surface cleaning compositions and is incorporated herein by reference.

In accordance with the instant invention certain nonionizing polymeric materials have been incorporated into granular hard surface cleaning compositions of the type discussed above. Similar and related polymeric materials have previously been utilized in other detergent compositions for a wide variety of purposes. Polymeric "anti-soil redeposition agents" and/or "soil suspending agents" are well known in the laundry detergent art. These polymeric materials are thought to provide a means by which removed soil in the laundry bath is kept from re-depositing on the washed fabrics. For example, U.S. Pat. No. 2,755,252, issued July 17, 1956 to Fong et al entitled "PARTIALLY-ACETYLATED POLYVINYL ALCOHOL AS A SOIL-SUSPENDING AGENT" describes the reduced re-deposition of soil on fabrics by the inclusion of polyvinyl alcohol in a laundry bath. Moreover, U.S. Pat. No. 3,000,830, issued Sept. 19, 1961 to Fong et al entitled "USE OF POLYVINYLPYRROLIDONE AS A SOIL-SUSPENDING AGENT" and U.S. Pat. No. 3,689,435, issued Sept. 5, 1972 to Berni et al entitled "DETERGENCY COMPOSITIONS CONTAINING A SYNERGISTIC MIXTURE OF PVP AND PVA" represent examples of the highly developed use of polymeric anti-soil redeposition agents in laundry detergent baths.

Besides soil suspending and/or anti-soil redeposition properties for laundry baths, other properties of polymers in general have made them suitable for use in certain types of detergent compositions as abrasives, encapsulating materials and viscosity modifiers. Some examples of such other uses of polymers in detergent compositions include U.S. Pat. No. 3,703,470, issued Nov. 21, 1972 to Brennan, and entitled "STORAGE STABLE DETERGENT COMPOSITION"; U.S. Pat. No. 3,819,525, issued June 24, 1974 to Hattenbrun, and entitled "COSMETIC CLEANSING PREPARATION"; South African Application 72/2050, filed Mar. 27, 1972 by Hampson et al, and entitled "LIQUID COMPOSITIONS"; U.S. Pat. No. 3,198,740, issued Aug. 3, 1965 to Dunlop et al and entitled "PACKET OF WATER-SOLUBLE FILM OF POLYVINYL ALCOHOL FILLED WITH DETERGENT COMPOSITION"; and U.S. Pat. No. 3,681,141, issued Aug. 1, 1972 to Muoio and entitled "PROCESS FOR CLEANING HARD SURFACES".

Surprisingly, it has been discovered that certain of these commonly used soil anti-redeposition agents, soil suspending agents, abrasives, encapsulating agents and viscosity modifiers can provide improved soil removal in the hard surface cleaning context, particularly in granular, non-acid compositions.

Despite the relatively widespread use of certain of such polymeric materials for a number of purposes in detergent compositions, it is believed that the unexpected soil removal benefits achieved through the incorporation of the polymeric materials herein described have not been heretofore recognized, especially at relatively low levels in granular hard surface cleaning compositions.

Accordingly, it is an object of the instant invention to provide granular hard surface cleaning compositions containing certain polymeric materials which improve the capability of hard surface cleaning compositions to remove soil.

It is a further object of the instant invention to provide hard surface cleaning compositions containing economically low levels of such polymeric materials.

It is still a further object of the instant invention to provide hard surface cleaning compositions which effectively remove soil from hard surfaces without the essential utilization of bleaches, enzymes or abrasives.

These and other objects are achieved as hereinafter disclosed.

SUMMARY OF THE INVENTION

The instant invention relates to built, low surfactant, granular detergent compositions which are especially effective for removing soil from hard surfaces. Such compositions comprise from about 0.05% to less than 5.0% by weight surfactant, from about 1% to about 99% by weight builder and from about 0.02% to about 3% by weight of polymeric material.

The surfactant component can be any conventional anionic, nonionic, ampholytic, zwitterionic surfactant or mixtures thereof. The builder can be any organic or inorganic builder salt or salt mixture.

The polymeric component comprises water-soluble or dispersible nonionizing polymers such as polyvinyl alcohol (degree of hydrolysis of about 60% to about 100%; degree of polymerization of from about 100 to about 7000); and polyvinyl pyrrolidone (degree of polymerization from about 50 to about 6000); or mixtures of these polymer types.

The instant invention also relates to a method for removing soil from hard surfaces. Such a method comprises contacting the soiled surface with an effective amount of an aqueous solution of a composition as described above and oscillating such a solution over the surface being cleaned.

DETAILED DESCRIPTION OF THE INVENTION

This invention is directed to granular hard surface cleaning compositions which provide improved cleaning performance after the incorporation of certain water-soluble or water-dispersible polymeric materials. Essential components of such compositions are polymeric material, surfactant, and builder. These and other invention aspects are described as follows.

Polymeric Material

The instant granular hard surface cleaning compositions contain from about 0.02% to about 3.0% by weight, preferably from about 0.02% to about 1.0% by weight of a polymeric material which serves to enhance the soil removal performance of the composition. These polymeric materials include specific types of polyvinyl alcohol, and/or polyvinyl pyrrolidone as described hereinafter. All of the polymeric materials used herein are water-soluble or water-dispersible and are nonionizing in water.

Polyvinyl alcohol is the preferred polymeric material for use in the instant compositions. Polyvinyl alcohol is a well-known polymer having the repeating monomeric unit $(—CH_2CHOH—)_x$. Polyvinyl alcohols are normally prepared by hydrolysis or polyvinyl acetate. The polyvinyl alcohol operable herein includes polyvinyl acetate polymers in which at least 60%, preferably 80% to about 100% and most preferably 97% to 100% of the acetate moieties are replaced by hydroxyl moieties. For simplicity, such polyvinyl alcohol materials are referred to herein as polyvinyl alcohol having at least 60% degree of hydrolysis, preferably at least about 80% to about 100% degree of hydrolysis, and most preferably 97% to 100% degree of hydrolysis.

Operable polyvinyl alcohols further include those which have a degree of polymerization of from about 100 to about 7000, preferably from about 200 to about 3500.

Polyvinyl alcohols are available commercially. Examples of such commercially available polyvinyl alcohols suitable for use herein are Elvanols marketed by E. I. Dupont and Company and Gelvatols marketed by Monsanto Company. These commercially available materials are often described with a molecular weight and a viscosity instead of in terms of degree of hydrolysis and polymerization. Accordingly, useful commercially available polyvinyl alcohols include those which have a molecular weight from about 4500 to about 300,000, preferably from about 9000 to about 150,000, and a viscosity (of a 4% aqueous solution at 20°C) of from about 3 centipose to about 100 centipose, preferably from about 4 centipose to about 50 centipose. Polyvinyl alcohol materials are described in more detail at pages 72 to 81 of the text, *Handbook of Common Polymers*, compiled by Roff et al, Butterworth & Co. (publishers), 1971 and *Polyvinyl Alcohol — Properties and Applications*, edited by C. A. Finch, John Wiley and Sons (Publishers), 1973, both books being incorporated herein by reference.

Another type of polymeric material operable in the instant composition is polyvinyl pyrrolidone. Chemically, polyvinyl pyrrolidones are homopolymers of N-vinylpyrrolidone. The repeating monomer is the following structure:

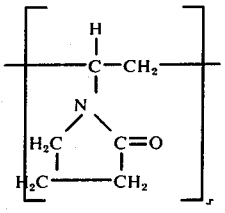

Polyvinyl pyrrolidones having a degree of polymerization of from about 50 to about 6000, preferably about 1500 to 3500 are useful for improving soil removal of the hard surface cleaning compositions of the present invention.

Examples of commercially available polyvinyl pyrrolidones include Plasdone marketed by GAF Corp. and Albigen A marketed by BASF Corp. These commercially available materials are also often described in terms of particular molecular weights. Accordingly, such available useful polyvinyl pyrrolidones include those having molecular weights of from about 10,000 to about 400,000, preferably from about 160,000 to about 360,000.

Either of the two above-described types of nonionizing polymeric materials can be used alone in the compositions of the present invention. As noted polyvinyl alcohols are the preferred materials. Mixtures of the two types of polymeric materials can also be employed.

Organic Surfactants

The organic surfactant compounds which can be utilized in the present invention include anionic, nonionic, ampholytic and zwitterionic surfactants and mixtures of these surfactants. These surfactants are included at levels which inhibit undesirable foaming and surface streaking yet which provide advantageous removal of soils, particularly soils of lipophylic and particulate character. Surfactant is incorporated at from about 0.05% to less than 5%, preferably from about 0.5% to about 3% by weight of the instant compositions.

Examples of suitable surfactants are listed hereinafter.

A. Anionic Soap and Non-Soap Synthetic Surfactants

This class of surfactants includes ordinary alkali metal soaps such as the sodium, potassium, ammonium and alkanol-ammonium salts of higher fatty acids containing from about 8 to about 24 carbon atoms and preferably from about 10 to about 20 carbon atoms. Suitable fatty acids can be obtained from natural sources such as, for instance, plant or animal esters (e.g., palm oil, coconut oil, babassu oil, soybean oil, castor oil, tallow, whale and fish oils, grease, lard, and mixtures thereof). The fatty acids also can be synthetically prepared (e.g., by the oxidation of petroleum, or by the Fischer-Tropsch process). Resin acids are suitable such as rosin and those resin acids in tall oil. Naphthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium or potassium tallow and coconut soap.

This class of anionic surfactants also includes water-soluble salts, particularly the alkali metal salts, of organic sulfuric reaction products having in their molecular structure an alkyl group containing from about 8 to about 22 carbon atoms and a sulfonic acid or sulfuric acid ester radical. (Included in the term alkyl is the alkyl portion of higher acyl groups.) Examples of this group of synthetic detergents which form a part of the built detergent compositions of the present invention are the sodium or potassium alkyl sulfates, especially those obtained by sulfating the higher alcohols ($C_8$–$C_{18}$ carbon atoms) produced by reducing the glycerides of tallow or coconut oil; sodium or potassium alkyl benzene sulfonates, in which the alkyl group contains from about 8 to about 16 carbon atoms in straight chain or branched chain configuration, e.g. those of the type described in U.S. Pat. Nos. 2,220,099 and 2,477,383 (especially valuable are linear straight chain alkyl benzene sulfonates in which the average of the alkyl groups is about 11–12 carbon atoms and commonly abbreviated as $C_{11.8}$LAS) sodium alkyl glyceryl ether sulfonates, especially those ethers of higher alcohols derived from tallow and coconut oil; sodium coconut oil fatty acid monoglyceride sulfonates and sulfates.

Other synthetic anionic surfactants useful herein and alkyl ether sulfates. These materials have the formula $RO(C_2H_4O)_xSO_3M$ wherein R is alkyl or alkenyl of about 10 to about 20 carbon atoms, $x$ is 1 to 30, and M is a watersoluble cation as defined hereinbefore. The alkyl ether sulfates useful in the present invention are condensation products of ethylene oxide and monohydric alcohols having about 10 to about 20 carbon atoms. Preferably, R has 12 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30, and especially 3 and 6, molar proportions of ethylene oxide and the resulting mixture of molecular species, having, for example, an average of 3 or 6 moles of ethylene oxide per mole of alcohol, is sulfated and neutralized.

Specific examples of alkyl ether sulfates of the present invention are sodium coconut alkyl ethylene glycol ether sulfate; lithium tallow alkyl triethylene glycol ether sulfate; sodium tallow alkyl hexaoxyethylene sulfate; and sodium tallow alkyl trioxyethylene sulfate. The alkyl ether sulfates are known compounds and are described in U.S. Pat. No. 3,332,876 to Walker (July 25, 1967), incorporated herein by reference.

Generally then, a wide variety of preferred anionic surfactants are useful in the instant compositions as providing the necessary detergency for hard surface cleaning. Most preferred anionic surfactants include $C_8$ to $C_{16}$ alkyl benzene sulfonates, $C_{12}$ to $C_{18}$ alkyl sulfates, and $C_{12}$ to $C_{18}$ ethoxylated alkyl sulfates having from 1 to 10 ethoxy moieties. For reasons of cleaning efficacy, economics and environmental compatibility, sodium linear alkyl benzene sulfonates having from 11 to 12 carbon atoms ($C_{11.8}$ avg.) in the alkyl portion are most particularly preferred, especially in combination with ethoxylated rosin acids such as tall oil which can be used as a spray-on or dedusting agent.

B. Nonionic Synthetic Surfactants

Nonionic surface active agents operable in the instant compositions can be any of three basic types - the alkylene oxide condensates, the amides and the semipolar nonionics.

The alkylene oxide condensates are broadly defined as compounds produced by the condensation of alkylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Examples of such alkylene oxide condensates include:

1. The condensation products of aliphatic alcohols with ethylene oxide. The alkyl chain of the aliphatic alcohol can either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-7 marketed by the Shell Chemical Company and Kyro EOB marketed by The Procter & Gamble Company.

2. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-610 marketed by the GAF Corporation; and Triton X-45, X-114, X-100 and X-102, all marketed by the Rohm and Haas Company.

3. The condensation products of ethylene oxide with a hydrophobic base formed by the condensation of propylene oxide with propylene glycol. The hydrophobic portion of these compounds has a molecular weight of from about 1500 to 1800 and of course exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially available Pluronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2500 to about 3000. This base is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

Examples of the amide type of nonionic surface active agent include the ammonia, monoethanol and diethanol amides of fatty acids having an acyl moiety of from about 8 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by the Fischer-Tropsch process.

Examples of the semi-polar type of nonionic surface active agents are the amine oxides, phosphine oxides and sulfoxides. These materials are described more fully in Berry, U.S. Pat. No. 3,819,528, issued June 25, 1974, incorporated herein by reference.

C. Ampholytic Synthetic Surfactants

Ampholytic synthetic detergents can be broadly described as derivatives of aliphatic amines which contain a long chain of about 8 to 18 carbon atoms and an anionic water-solubilizing group, e.g. carboxy, sulfo or sulfato. Examples of compounds falling within this definition are sodium 3-dodecylamino-propionate, sodium -3-dodecylamino propane sulfonate, and dodecyl dimethylammonium hexanoate.

D. Zwitterionic Synthetic Surfactants

Zwitterionic surface active agents operable in the instant composition are broadly described as internallyneutralized derivatives of aliphatic quaternary ammonium and phosphonium and tertiary sulfonium compounds, in which the aliphatic radical can be straight chain or branched, and wherein one of the aliphatic substituents contains from about 8 to 18 carbon atoms and one contains an anionic water solubilizing group, e.g., carboxy, sulfo, sulfato, phosphato, or phosphono. Some of these zwitterionic surfactants are described in the following U.S. Pat. Nos. 2,129,264; 2,178,353; 2,774,786; 2,813,898; and 2,828,332. The ammoniopropane sulfonates containing about 8 to about 21 carbon atoms are one class of surfactant compounds preferred herein by virtue of their relatively low calcium ion (hardness) sensitivity.

Of all the above described surfactants, anionic surfactants are the most preferred. An especially preferred anionic surfactant component comprises a mixture of sodium linear $C_{11-12}$ alkyl benzene sulfonate (LAS) and ethoxylated tall oil. Such a mixture is generally present in the instant composition in amounts such that the LAS comprises from about 0.05% to 3% by weight of the composition and the ethoxylated tall oil component comprises from about 0.05% to 0.5% by weight of the composition.

Builder Salts

Builder salts are essential to the compositions herein and comprise from about 1% to about 99% by weight of the hard surface cleaning composition, preferably from about 25% to about 99% by weight, depending on builder efficacy and economics.

Suitable builders are water-soluble or water-dispersible in nature and comprise organic and inorganic salts. Mixtures of organic and inorganic builders can be employed.

Suitable inorganic alkaline builder salts which can be used in this invention alone or in admixture include alkali metal carbonates, borates, phosphates, polyphosphates, bicarbonates, and silicates. Ammonium or substituted ammonium e.g., triethanol ammonium salts of these materials can also be used. Specific examples of suitable salts are sodium tripolyphosphate, sodium carbonate, sodium tetraborate, sodium and potassium pyrophosphate, sodium and ammonium bicarbonate, potassium tripolyphosphate, sodium hexaphosphate, sodium sesquicarbonate, sodium orthophosphate and potassium bicarbonate. The preferred inorganic alkaline builders according to this invention are the alkali metal phosphates, carbonates, silicates, polyphosphates and sesquicarbonates.

Examples of suitable organic alkaline builder salts used in this invention alone or in admixture are alkali metal, ammonium or substituted ammonium aminocarboxylates, e.g., sodium and potassium ethylenediaminetetraacetate (EDTA), sodium and potassium N-(2-hydroxyethyl)-ethylenediaminetriacetates, sodium and potassium nitrilotriacetates (NTA) and sodium, potassium and triethanolammonium N-(2-hydroxyethyl)-nitrilodiacetates. Mixed salts of these polycarboxylates are also suitable. The alkali metal, ammonium and alkanolammonium salts of citric acid can also be employed. The alkali metal salts of phytic acid, e.g., sodium phytate are also suitable as organic alkaline sequestrant builder salts.

Polyphosphonates are also valuable builders in terms of the present invention including specifically sodium and potassium salts of ethane-1-hydroxy-1,1-diphosphonic acid, sodium and potassium salts of methylene diphosphonic acid, and sodium and potassium salts of ethane-1,1,2-triphosphonic acid. Other examples include the alkali metal salts of ethane-2-carboxy-1,1-diphosphonic acid, hydroxymethanediphosphonic acid, carbonyldiphosphonic acid, ethane-1-hydroxy-1,1,2-triphosponic acid, ethane-1-hydroxy-1,1,2-triphosphonic acid, propane-1,1,3,3-tetraphosphonic acid, propane-1,1,2,3-tetraphosphonic acid, and propane-1,2,2,3-tetraphosphonic acid.

Useful builders can be formulated to provide phosphate-containing or phosphate-free cleaning compositions, although phosphate-containing compositions are preferred from the standpoint of soil removal and economics.

Preferred granular phosphate-containing hard surface cleaning compositions comprise by weight percent from about 5% to 65% alkali metal phosphate mixtures. These phosphate mixtures comprise from about 5% to 50% alkali metal polyphosphates and from about 0 to 35% alkali metal orthophosphates. These phosphate compositions can further contain from about 25% to about 90% alkali metal carbonates (including sesquicarbonate) and from about 0% to 5% alkali metal silicates.

Preferred granular phosphate-free hard surface cleaning compositions contain on a weight basis from about 0.5% to about 25% of organic builders such as citrates, ethylenediamineacetates, and nitriloacetates and mixtures thereof; from about 40% about 95% alkali metal carbonates (including preferably 25% to about 90% sesquicarbonate); and from about 0% to 5% alkali metal silicates.

Optional Ingredients

In addition to the above-described essential components the granular compositions of the instant invention can optionally contain such conventional detergent composition components as moisture (free or bound), fillers (neutral salts, e.g., sodium sulfate) bleaches, processing aids, enzymes, abrasives, perfumes, pH control agents and coloring agents. If such components are present they generally comprise from 0.05% up to as much as 50% by weight or more of the composition especially if high levels of fillers are employed. Preferably, however, the compositions are free of bleaches and/or enzymes which could be potentially detrimental to certain types of surfaces being cleaned.

Composition Preparation

The granular compositions of the instant invention can be prepared simply by admixing the essential and optional components together in granular form. Alternatively, the surfactant, builder and appropriate optional components including polymeric materials can be admixed with water in a crutcher and spray dried to granular form. Polymeric materials and other optionals can also be further admixed into the composition, if desired.

The polymeric materials of the present invention can be incorporated into hard surface cleaning compositions in a variety of forms. However, it is particularly desirable that the polymeric materials be in a form which can readily dissolve or disperse upon dilution of the hard surface cleaner with water. Consequently, preferred hard surface cleaning compositions contain polymeric material mixed throughout the composition in readily dispersible or dissolvable form. Most preferably, the polymeric material is in a form which readily dissolves or disperses in aqueous solution upon dilution of 1 part cleaning composition with from about 30 to about 65 parts of water at normal usage temperatures.

One such dispersible or dissolvable form is provided simply by admixing the surfactant and builder granules with the polymeric material which is in the form of small particles or aggregates ranging from about 10 to about 300 microns in diameter. Particles having average diameters below about 40 microns are preferred for the polymeric materials.

Alternatively, the polymeric materials can be melted or dissolved in a solvent such as water and sprayed onto one or more of the hard surface cleaning composition granular components. For example, a molten or aqueous slurry of the polymeric material can be sprayed onto an agitated dry mixture of builder and, optionally, surfactant. It is desirable that compositions prepared in this manner exhibit no substantial delay in solubility. Consequently, the layer of polymeric film on the composition granules should be relatively thin and highly water-soluble or dispersible at normal usage temperatures. Usually such as polymer layer is less than about 100 microns in average thickness.

The polymeric materials can also be used to wholly encapsulate certain hard surface cleaning composition adjuvants such as, for example, volatile perfume. Encapsulation techniques using polymeric materials, including polyvinyl alcohol, are known. (See, for instance, U.S. Pat. No. 3,015,128, issued Jan. 2, 1962 to Somerville, relating to encapsulation of liquids with a mixture of polyvinyl alcohol and alginates. This patent is incorporated herein by reference.) Again, however, it is desirable that the polymeric material be in a form which readily dissolves or disperses upon dilution of the cleaning composition with water.

A single composition herein can, of course, contain the polymeric material in several different forms. Thus a composition can contain some polymeric material, say 5% to about 50% by weight of the polymeric component, in the form of encapsulation material and some, say from about 50% to about 95% by weight of the polymeric material in particulate form.

Hard Surface Cleaning

Cleaning of hard surfaces using the compositions of the present invention can be accomplished in conventional manner. Generally the composition is dissolved in water to form an aqueous cleaning solution. This cleaning solution is then contacted with the surface to be cleaned. A substrate such as a mop, sponge, cloth, brush, etc., is used to oscillate the cleaning composition across the hard surface thereby loosening, dissolving and removing soil.

Cleaning solutions formed from the compositions of the instant invention generally contain from about 50 ppm to 1000 ppm surfactant, from about 100 ppm to 20,000 ppm builder and from abut 2.0 ppm to 1000 ppm of the polymeric material.

It is highly preferred that the cleaning solution formed from the compositions herein have a non-acid pH. Thus preferably the instant compositions when dissolved should provide aqueous solutions having a pH within the range of from about 7 to 12, more preferably 9 to 11.

The following exemplifies the hard surface cleaning compositions of this invention and the soil removal benefit achieved by incorporation of the polymeric materials herein into such compositions. These examples are illustrative of the present invention and are not considered as limiting thereof.

EXAMPLE I

The granular hard surface cleaning composition of the following formulation is prepared in conventional manner.

| Component | Weight Percent |
|---|---|
| Surfactant | |
| Sodium $C_{11.8}$ linear alkyl benzene sulfonate ($C_{11.8}$ LAS) 0.9% | 1 |
| Sterox CD* (ethoxylated (avg. 11 moles) tall oil) 0.1% | |
| Sodium tripolyphosphate | 20 |

-continued

| Component | Weight Percent |
|---|---|
| Trisodium phosphate | 20 |
| Sodium sesquicarbonate | 57 |
| Polyvinyl alcohol soil removal agent (Elvanol 90-50**, 99%-100% hydrolyzed, viscosity = 12-14 cp.) | 0.05 |
| Moisture and miscellaneous | Balance |
| | 100% |

*Marketed by Monsanto Company
**Marketed by E. I. Dupont

Such a composition can be dissolved in water to the extent of about 1.3% by weight to provide a cleaning solution suitable for effectively removing a variety of soil types from a variety of hard surfaces. Use of such a cleaning solution in conventional manner produces little undesirable solution foaming. Cleaning solutions prepared in this manner from such a composition leave little unsightly filming or streaking on hard surfaces cleaned therewith.

Compositions of substantially similar performance characteristics are realized when in the Example I composition the PVA material is replaced with an equivalent amount of a commercially available polyvinyl pyrrolidone, such as K-60 marketed by GAF Corp. having a degree of polymerization of about 1500.

Soil Removal Evaluation Method

The ability of the compositions of the instant invention to remove soil from hard surfaces is evaluated by means of the following procedure. Surfaces consisting of individual linoleum and vinyl asbestos tiles are treated with various types of soil formulated to simulate naturally occurring home cleaning situations. Linoleum (L) and vinyl asbestos (VA) are common flooring materials representative of the types of surfaces encountered by persons cleaning in home and industry. Rectangular tiles of 25.4 cm long and 6.2 cm wide are used in the evaluation.

Standard soil types approximating normal household soils are used in determining cleaning efficacy. One soil is called "particulate soil" (PS) and simulates a street-like soil which contains a mixture of soot, clay, rust, sand, cement and humus combined with a small proportion of greasy/fatty materials. This particulate soil is brushed on the tiles and left to age at room temperature for varying times, usually at least about one week.

A second soil employed in evaluation is called "kitchen type soil" (KTS) and comprises a mixture of fatty materials, predominately unsaturated oils, combined with a minor amount of a particulate type soil. This KTS soil is sprayed onto the tiles and then aged at room temperature for relatively long periods, usually at least about 1-2 months. Alternatively, higher temperature aging is used to shorten the time necessary to prepare the soiled tiles.

A third soil used herein is called waxy soil (WS) and has a waxy component consisting of floor wax. This soil further has particulate soil and fatty materials mixed in and is placed on a clean tile with a roller. The tile is usually aged for about one week or more a room temperature before testing.

A modified Gardner Washability Machine is employed to simulate normal hard surface washing conditions. Basically, this Washability Machine is a device which holds a sponge having cleaning solution soaked therein onto a tile surface which is to be cleaned. This sponge is then mechanically drawn at constant rate and pressure across the tile to be cleaned, each completed pass being called a stroke. After a predetermined number of passes or strokes, the tile surface is evaluated for cleanliness. Utilization of the modified Gardner Washability Machine allows for each individual soiled tile to be washed with five different cleaning solutions.

Grading experts visually evaluate soil removal performance by comparing soil removal achieved with a standard cleaning composition (Basis) and soil removal achieved with the compositions such as those of the instant invention, which further contain the polymeric material herein. Replicate testing is carried out making paired comparisons between individual treatments on a single tile.

The following scale is utilized to quantify the differences between the pairs of cleaned surfaces seen by the visual graders.

Visual Scoring Scale

0 — equal
±1 — I think there is a difference
±2 — I know there is a difference
±3 — I know there is a large difference
±4 — I know there is a very large difference Numerical data obtained from this visual scoring scale are treated statistically by analysis of variance. Positive scores indicate a noticeable improvement in cleaning as compared to cleaning of the basis or standard composition.

EVALUATION RESULTS

Several cleaning solutions are prepared by dissolving compositions substantially similar to those of Example I to the extent of about 1.3% by weight in water of 5-7 grain/gal. hardness and 46°C. The control or basis solutions are prepared by dissolving compositions similar to the Example I composition but with no polymeric material. Test solutions are prepared from (a) compositions similar to the Example I composition with polyvinyl alcohol and (b) compositions similar to the Example I composition with polyvinyl pyrrolidone.

Soil removal grading results in Grading Scale Units (GSU) are provided in Table I. Each number represents an evaluation of a particular test solution as compared to the basis solution. Conditions vary between different test solutions, but conditions for each basis/test pair for a given run are substantially equivalent.

The results in Table I show that the polymeric materials herein can provide significantly improved cleaning at a 95% statistical confidence level inasmuch as all positive numbers represent a significant improvement in soil removal over the particular basis solution. It should be noted that polyvinyl pyrrolidones of relatively low molecular weights (i.e., from about 5000 to about 80,000) do not provide significantly measurable cleaning benefits in such compositions as such low levels of polymeric material. Beginning at about 0.2% and higher by weight, in product these lower molecular weight polyvinyl pyrrolidones provide noticeable cleaning benefits.

TABLE I

| Standard | | L/WS (GSU) Basis | VA/WS (GSU) Basis | L/KTD (GSU) Basis | L/PS (GSU) Basis |
|---|---|---|---|---|---|
| +0.05% PVA Elvanol 90-50 | (Test 1)[1] | +1.7 | — | +1.3 | — |
| +0.05% PVA Elvanol 70-05 | (Test 2)[2] | +1.6 | +1.4 | +0.9 | — |
| +0.05% PVA Elvanol 51-05 | (Test 3)[3] | +2.0 | +1.3 | +1.6 | +1.8 |
| +0.05% PVP K-60 | (Test 4)[4] | +1.6 | — | — | — |

[1]Marketed by E. I. Dupont (99%-100% hydrolyzed; 12-14 cp. at 20°C, 4% by weight aqueous solution).
[2]Marketed by E. I. Dupont (99%-100% hydrolyzed; 4-6 cp. at 20°C, 4% by weight aqueous solution).
[3]Marketed by E. I. Dupont (88%-89% hydrolyzed; 4-6 cp. at 20°C, 4% by weight aqueous solution).
[4]Marketed by GAF Corp. (K-60, mol. wt. 160,000).

What is claimed is:

1. A method for removing soil from hard surfaces, the method comprising:

a. contacting a surface with an aqueous solution containing 1. from about 50 ppm to about 1000 ppm of a surfactant selected from the group consisting of anionic, nonionic, ampholytic, zwitterionic surfactants, and mixtures thereof;
2. from about 100 ppm to about 20,000 ppm of a builder selected from the group consisting of organic and inorganic builders and mixtures thereof;
3. from about 2 ppm to about 1000 ppm of a water soluble or dispersible nonionizing polymeric material selected from the group consisting of polyvinyl alcohols having a degree of hydrolysis of from about 60% to about 100% and a degree of polymerization of from about 100 to about 7000; and polyvinyl pyrrolidones having a degree of polymerization of from about 50 to about 6000; and mixtures thereof; and b. oscillating the solution across the hard surface to remove the soil thereon.

2. A process according to claim 1 wherein the polymeric material is polyvinyl alcohol.

3. A process according to claim 2 wherein the surfactant is an anionic surfactant.

4. A process according to claim 3 wherein the anionic surfactant is selected from the group consisting of $C_8$ to $C_{16}$ alkylbenzene sulfonates, $C_{12}$ to $C_{18}$ alkyl sulfates, and $C_{12}$ to $C_{18}$ alkyl sulfates having from 1 to 10 ethoxy moieties.

5. A process according to claim 3 wherein the builder is an alkali metal salt of an anionic moiety selected from the group consisting of carbonates, phosphates, citrates, borates, bicarbonates, sesquicarbonates, silicates, polyphosphates, and mixtures thereof.

* * * * *